US006464468B2

(12) United States Patent
Colburn

(10) Patent No.: US 6,464,468 B2
(45) Date of Patent: Oct. 15, 2002

(54) PERSONAL SMOKE REPELLER

(76) Inventor: Kris Colburn, 14401 SE. Petrovitsky Rd.,#B-103, Renton, WA (US) 98058

( * ) Notice: Subject to any disclaimer, the term of this patent is extended or adjusted under 35 U.S.C. 154(b) by 0 days.

(21) Appl. No.: 09/752,194

(22) Filed: Dec. 29, 2000

(65) Prior Publication Data

US 2002/0085926 A1 Jul. 4, 2002

(51) Int. Cl.[7] ..... F04B 53/00; F04B 17/00; F04D 29/00; F04D 29/70

(52) U.S. Cl. ..... 417/234; 417/411; 416/247 R; 416/63

(58) Field of Search ..... 417/234, 411; 416/205, 244 R, 247 R, 63

(56) References Cited

U.S. PATENT DOCUMENTS 3,262,638 A * 7/1966 Militello ..... 230/275
D264,016 S * 4/1982 Fournier ..... D2/253
4,672,968 A 6/1987 Lenox et al.
4,744,106 A 5/1988 Wang
5,046,329 A * 9/1991 Travis, III ..... 62/256.3
D341,195 S 11/1993 Standhardt
5,304,035 A * 4/1994 Carter ..... 416/63
5,425,620 A 6/1995 Stroud
5,429,481 A * 7/1995 Liu ..... 416/246
5,438,698 A * 8/1995 Burton et al. ..... 455/351
5,558,501 A * 9/1996 Wang et al. ..... 416/244 R
5,749,359 A * 5/1998 Hansen ..... 128/205.25

* cited by examiner

*Primary Examiner*—Charles G. Freay
*Assistant Examiner*—Timothy P. Solak
(74) *Attorney, Agent, or Firm*—Henderson & Sturm LLP

(57) ABSTRACT

A personal fan construction 10 for blowing noxious fumes and odors away from a user's breathing passages and including a fan unit 13 mounted on a housing member 30 that is provided with at least one slot 32 dimensioned to receive a strap unit 11 for securing the construction 10 to a selected portion of a user's anatomy; wherein, said fan unit 13 is angularly adjustable relative to both said housing member 30 and the strap unit 11.

9 Claims, 2 Drawing Sheets

PERSONAL SMOKE REPELLER

BACKGROUND OF THE INVENTION

1. Field of the Invention

The present invention relates to the field of miniature and/or body supported fan constructions in general and in particular to a strap mounted fan that can be selectively mounted on various portions of a user's anatomy.

2. Description of Related Art

As can be seen by reference to the following U.S. Pat. Nos. D341,195; 4,672,968; 4,744,106 and 5,425,620, the prior art is replete with myriad and diverse miniature personal fan constructions.

While all of the aforementioned prior art constructions are more than adequate for the basic purpose and function for which they have been specifically designed, they are uniformly deficient with respect to their failure to provide a simple, efficient, and practical body supported personal fan construction that is adapted to be selectively placed in different positions of a user's person to direct noxious odors away from the user's face rather than for the more common usage of personal fans simply for cooling the user's skin.

As most smoke sensitive people are aware, there are many instances in their personal life when they are unable to avoid coming into contact with cigarette smoke such as in casinos, bowling alleys, bars, at sporting events and while traveling abroad.

As a consequence of the foregoing situation, there has existed a longstanding need for a new and improved personal fan construction that is adapted to be selectively positioned on different portions of their anatomy to direct noxious odors way from their nasal passages in a relatively unobtrusive and barely audible fashion; and the provision of such an arrangement is the stated objective of the present invention.

BRIEF SUMMARY OF THE INVENTION

Briefly stated, the personal construction that forms the basis of the present invention comprises in general a strap unit, a mounting unit and a fan unit.

As will be explained in greater detail further on in the specification, the strap unit includes a strap member of a size dimensioned to accommodate different portions of a user's anatomy such as the neck, head, wrist or upper arms wherein the strap member is also adapted to be releasably secured to the mounting unit.

The mounting unit in turn comprises a housing member provided with one or more slots which accept the passage of the strap member wherein the housing member further includes the electrical batteries, wires and switch required to operate the fan unit.

In addition the fan unit includes a fan member that is adapted to be pivotally disposed on the mounting unit such that the angular orientation of the fan member can be varied to direct the flow of air from the fan member in a direction generally away from the user's face as opposed to the directional orientation of most other personal fans.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
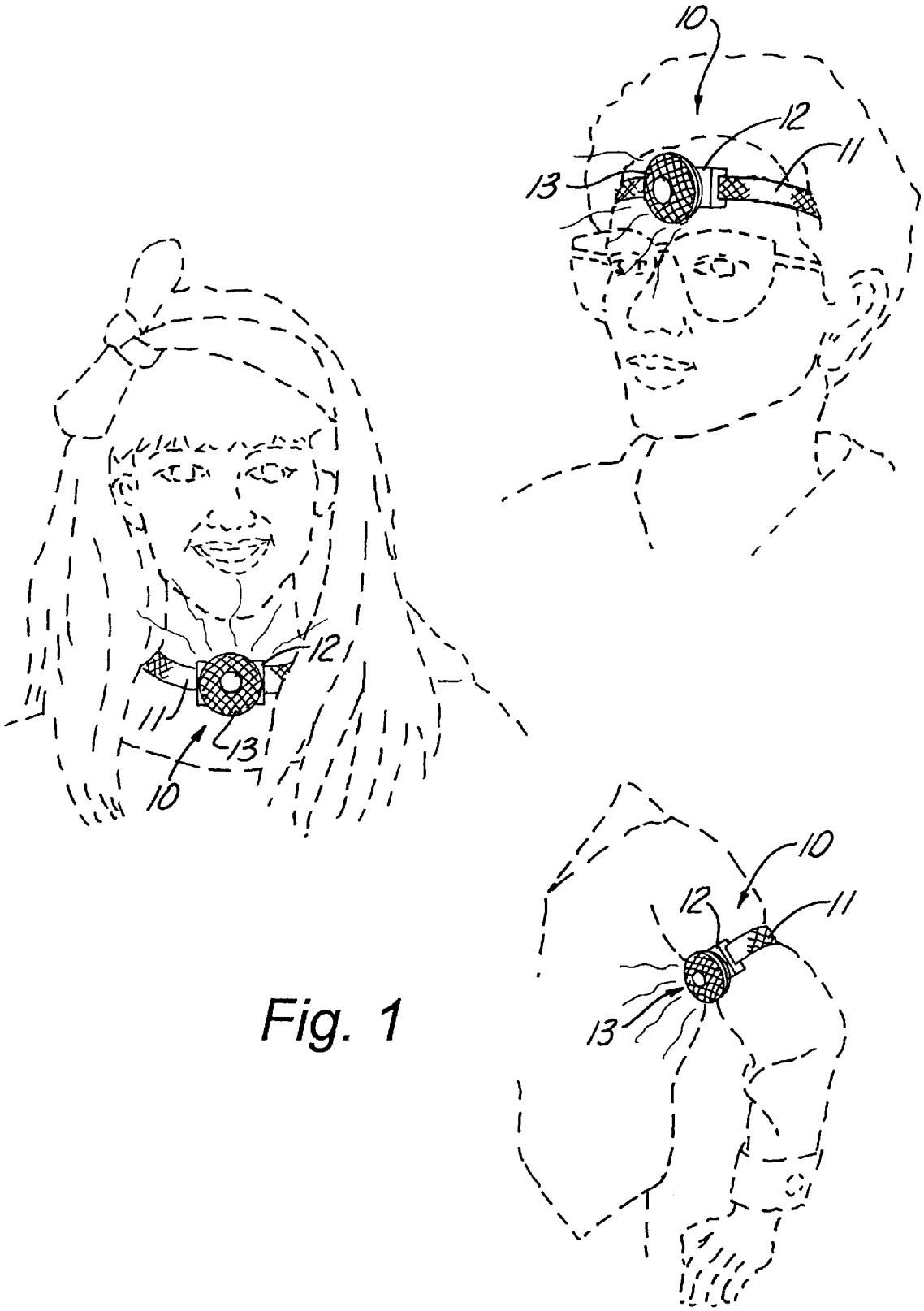
FIG. 1 shows the personal fan construction that forms the basis of this invention worn on different portions of a user's anatomy.

As can be seen by reference to the drawings, and in particular to FIG. 1, the personal fan construction that forms the basis of the present invention is designated generally by the reference number 10. The construction 10 comprises in general a strap unit 11, a mounting unit 12, and a fan unit 13. These units will now be described in seriatim fashion.

Figure 5:
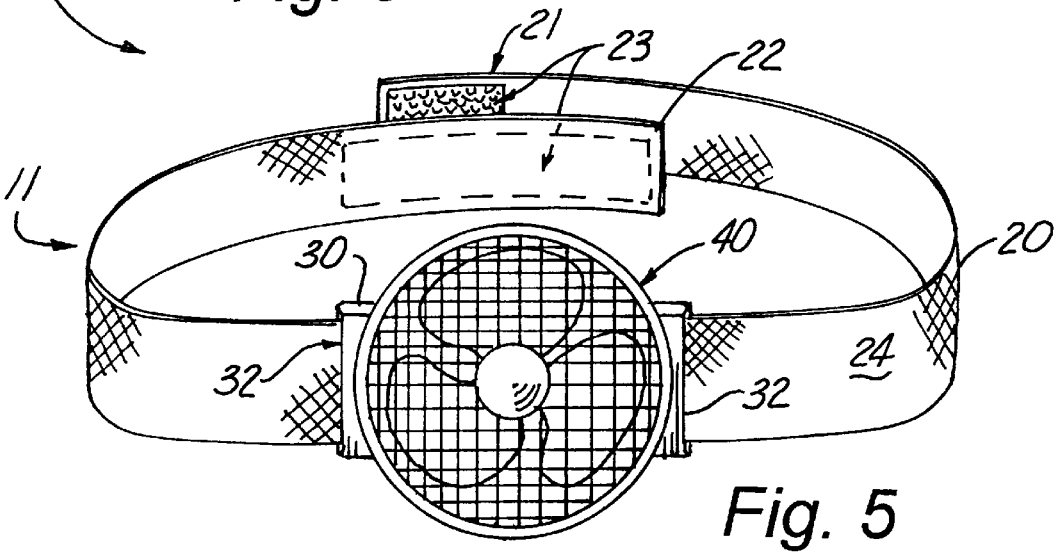

As can best be seen by reference to FIG. 5, the strap unit 11 comprises a relatively thin, flat, narrow strap member 20 whose opposite ends 21 22 are provided with conventional cooperating fastener elements 23 such as the hook and loop fasteners depicted, snaps, buttons, clasps, belt buckle, etc.

In addition, in the preferred embodiment of the invention, the strap member 20 is further fabricated from a generally flexible stretchy, woven material 24 that will expand and be breathable. However, it is to be understood that for the purposes of this invention leather, rubber, plastic or other non-stretchable synthetic material could be substituted therefor.

Figure 2:
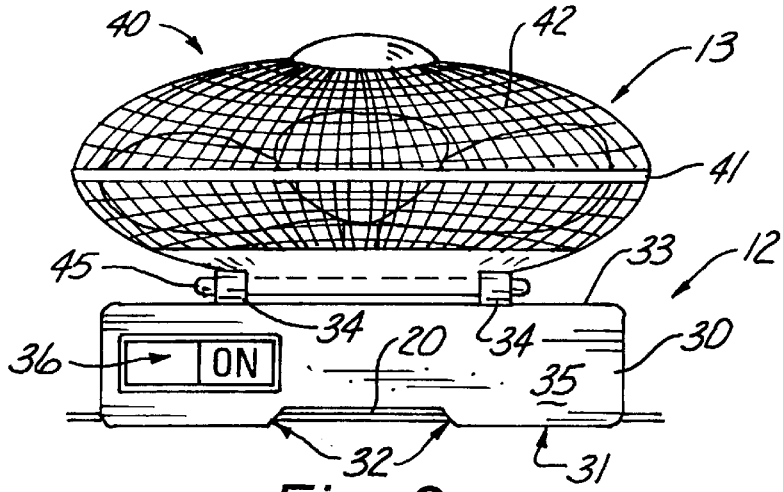
FIG. 2 is a top plan view of the fan unit, the mounting unit and a portion of the strap unit.
Figure 3:
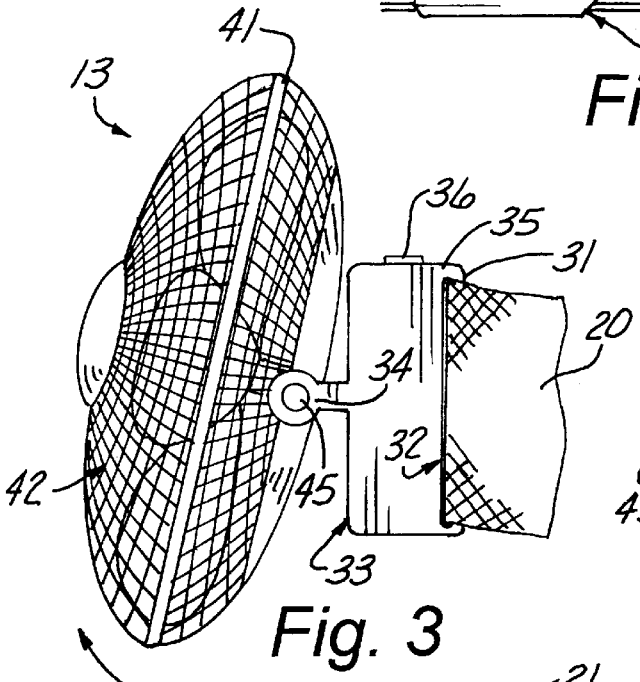
FIG. 3 is a side elevation view showing the fan unit, the mounting unit and a portion of the strap unit.
Figure 4:
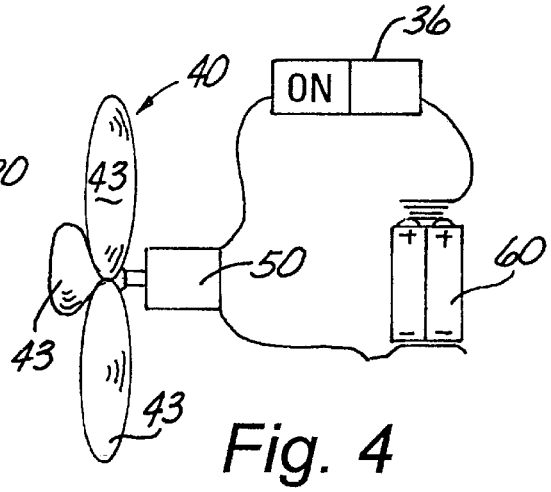
FIG. 4 is a schematic view of the electrical system that controls the operation of the fan unit; and, FIG. 5 is a front perspective view of the personal fan construction.

Turning now to FIGS. 2 and 3, it can be seen that the mounting unit 12 comprises in general a slim profile housing member 30 having a rear face 31 provided with one or more slots 32 dimensioned to receive the passage of the strap member 20 there through in a well recognized fashion to form the operative connection between the strap unit 11 and the mounting unit 12.

Still referring to FIGS. 2 and 3, it can also be seen that the housing member 30 is also provided with a front face 33 having a pair of outwardly projecting axially aligned hub elements 34 whose purpose and function will be described presently.

In addition, the housing member 30 is further provided with a top surface 35 having a switch element 36 which is used to control the operation of the fan unit 13 which will be described next.

As shown in FIGS. 2 through 5, the fan unit 13 comprises a fan member 40 driven by a small electrical fan motor 50 disposed within the housing member 30 and powered by batteries wherein the flow of electrical current from the batteries 60 to the fan motor 50 is controlled by the switch element 36 in a well recognized manner.

In addition, as can best be seen by reference to FIGS. 2 and 3, the fan member 40 is further provided with a clamshell shaped fan blade housing 41 substantially fabricated from a fine mesh screen material 42 whose discrete mesh openings are specifically designed to prevent the user's hair from becoming caught by the rotating fan blades 43; whereas most fan screens have substantially larger mesh openings to prevent larger objects such as fingers or the like from coming into contact with the rotating fan blades 43.

Furthermore, the rear portion of the fan blade housing 41 is also provided with a generally tangentially disposed pivot rod element 45 which is adapted to be rotatably suspended within the hub elements 34 which extend outwardly from the front face 33 of the housing member 30 such that the angular orientation of the fan unit 13 relative to the mounting unit 12 can be varied in a well recognized fashion.

By now it should be appreciated that the personal fan construction of this invention is specifically designed to be worn around the user's neck, forehead, or arm and positioned in such a manner as to direct ambient air flow away from the user's nasal passages to repel smoke or other noxious odors from bothering the user.

It should also be noted that the discreet size of this fan construction easily allows decorative components to be added to the fan construction to camouflage the true purpose and function of the apparatus.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A personal fan construction consisting of:

a strap unit including an elongated strap member dimensioned to encircle a selected portion of a user's anatomy and having opposite ends provided with cooperating fastener elements;

a mounting unit including a housing member having a rear face provided with at least one slot dimensioned to receive a selected portion of said strap member, a top surface, a bottom surface, and a front face; and a fan unit including a fan member operatively associated with the front face of the housing member and including a fan motor and a power source wherein the fan member is angularly adjustable relative to the front face of the housing member wherein the front face of the housing member is provided with a pair of outwardly projecting hub elements disposed intermediate the top surface and the bottom surface and adapted to rotatably receive a portion of said fan member; and wherein said fan member is provided with a fan blade housing having a rear central portion provided with a transversely disposed pivot rod element that is dimensioned to be received in said hub elements.

2. The construction as in claim 1, wherein said power source comprises at least one battery disposed within said housing member.

3. The construction as in claim 2, wherein said fan motor is disposed within said housing member.

4. The construction as in claim 3, further including a switch element for controlling the supply of electricity from the power source to said fan motor.

5. The construction as in claim 4, wherein said switch element is disposed on the top surface of the housing member.

6. The construction as in claim 2, wherein the front face of the housing member is provided with a pair of outwardly projecting hub elements adapted to rotatably receive a portion of said fan member.

7. The construction as in claim 6, wherein said fan member is provided with a fan blade housing having a rear portion provided with a transversely disposed pivot rod element that is dimensioned to be received in said hub elements.

8. The construction as in claim 1; wherein, said fan blade housing is substantially fabricated from a fine mesh screen material.

9. The construction as in claim 8; wherein, said fan blade housing has a generally clam shell configuration.

* * * * *